US009495820B1

(12) United States Patent
Li

(10) Patent No.: US 9,495,820 B1
(45) **Date of Patent: *Nov. 15, 2016**

(54) ELECTRONIC COMBINATION LOCK

(71) Applicant: DigiPas USA, Inc., Avon, CT (US)

(72) Inventor: Hui Hong Jim Kery Li, Singapore (SG)

(73) Assignee: DIGIPAS USA, LLC, Avon, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/821,049

(22) Filed: Aug. 7, 2015

Related U.S. Application Data

(63) Continuation-in-part of application No. 13/698,458, filed as application No. PCT/SG2010/000194 on May 25, 2010, now Pat. No. 9,121,199.

(51) Int. Cl.

| | |
|---|---|
| ***G07C 9/00*** | (2006.01) |
| ***E05B 47/00*** | (2006.01) |
| ***E05B 37/00*** | (2006.01) |
| ***E05B 67/06*** | (2006.01) |
| ***E05B 49/00*** | (2006.01) |

(52) U.S. Cl.
CPC ..... *G07C 9/00174* (2013.01); *E05B 37/0068* (2013.01); *E05B 47/0001* (2013.01); *E05B 49/002* (2013.01); *E05B 67/06* (2013.01); *E05B 2047/0048* (2013.01); *E05B 2047/0067* (2013.01); *E05B 2047/0072* (2013.01)

(58) Field of Classification Search
CPC ... E05B 19/0005; E05B 41/00; E05B 17/226
See application file for complete search history.

(56) References Cited

U.S. PATENT DOCUMENTS

| | | | | |
|---|---|---|---|---|
| 3,754,164 | A | 8/1973 | Zorzy | |
| 4,495,540 | A | 1/1985 | Remington et al. | |
| 4,896,246 | A * | 1/1990 | Henderson | G07C 1/32 361/171 |
| 4,931,789 | A | 6/1990 | Pinnow | |
| 5,021,776 | A | 6/1991 | Anderson et al. | |
| 5,153,561 | A | 10/1992 | Johnson | |
| 5,373,718 | A | 12/1994 | Schwerdt et al. | |
| 5,522,243 | A * | 6/1996 | Kusmiss | E05B 37/0068 434/113 |
| 6,337,618 | B1 | 1/2002 | Craig et al. | |
| 2010/0283579 | A1 * | 11/2010 | Kraus | G07C 9/00944 340/5.7 |

FOREIGN PATENT DOCUMENTS

| | | | |
|---|---|---|---|
| JP | 07-113364 | A | 5/1995 |
| JP | 08-184233 | A | 7/1996 |
| JP | 09-13769 | A | 1/1997 |
| JP | 09-209630 | A | 8/1997 |
| JP | 09-303013 | A | 11/1997 |
| JP | 11-71948 | A | 3/1999 |
| JP | 2009-035866 | A | 2/2009 |
| JP | 2010013081 | A | 1/2010 |
| WO | 2009014943 | A1 | 1/2009 |

* cited by examiner

*Primary Examiner* — Omeed Alizada
(74) *Attorney, Agent, or Firm* — McCormick, Paulding & Huber LLP

(57) ABSTRACT

Disclosed herein is an electronic combination lock mainly characterized by miniature size and easy-to-use electronic identification access-gaining method that enables a vast variety and type of access codes for user setting and choice. Another battery operated electronic key unit, incorporated with programmed access code to provide as an alternative choice for locking, unlocking and backup power, can be used in conjunction with the electronic combination lock.

20 Claims, 7 Drawing Sheets

ELECTRONIC COMBINATION LOCK

CROSS-REFERENCE TO RELATED APPLICATIONS

This application is a continuation-in-part of U.S. application Ser. No. 13/698,458, filed Nov. 12, 2012, which claims the benefit of International Application No. PCT/SG2010/000194, filed May 25, 2010, each of which is hereby incorporated by reference in its entirety.

BACKGROUND OF THE INVENTION

Typical conventional locking devices, such as padlocks and luggage locks, require user to manually enter a sequence of numbers by adjusting multi-rotating dials inscribed with numeric digits to open a lock. This type of locking devices is commonly known as Combination Locks and they usually do not require a mechanical key. Instead users need to preset a combination digit code and remember this code when unlocking such locks. In contrast, existing electronic locks are usually designed with a bulky and relatively large numeric keypad for entering access codes. These keypads are not suitable for used in small size electronic combination locks.

The invention is concerned with small size electronic combination locks. In particular, the invention relates to miniaturization and an easy-to-use electronic identification method for setting locking and unlocking combination access code of electronic combination locks such as padlocks, chain locks, luggage locks, wire locks and bicycle locks.

The method of adjusting mechanical combination codes to unlock conventional locking devices is cumbersome and time consuming. The problems of using such combination locks are as follows: (1) reading and adjusting small size of inscribed digits on the rotating dials become tedious and time consuming (2) limited numeric digits from 0 to 9 resulted little choices of access code that can be formed by user (3) memorizing multiple numeric digits of access codes can be difficult to some users.

In addition to above shortcomings of conventional combination locks, there has been a need for a small electronic lock operated by an electronic identification device with characteristics as follows: easy to use due to its simplicity, increased variety of choices of combination codes, very low battery power consumption, and relatively inexpensive construction.

U.S. Pat. No. 4,495,540, describes an electronic combination lock for luggage. The electronic combination lock described in this patent comprises several buttons which emulate the mechanical adjustable rings in conventional combination locks. It is a replicate of multi-digit mechanical adjustable rings to several electronic push buttons. These multiple buttons method of entering access code is not suitable for application in small electronic combination locks. The patent is incorporated here for reference.

The followings additional patents are believed to have relevance to the invention: U.S. Pat. No. 3,754,164, U.S. Pat. No. 4,931,789, U.S. Pat. No. 5,021,776, U.S. Pat. No. 5,153,561, U.S. Pat. No. 5,373,718, To address the weaknesses and the needs described above, the inventor proposed an alternative electronic combination lock which provides the public with a useful choice.

SUMMARY OF INVENTION

The invention provides an electronic combination lock comprising an electronic system unit, a mechanical housing, a miniaturized latch and a set of switches or sensor to manually and automatically turn on/off the electronic system. The electronic system consist of a visual display unit, a small Joystick switch or a set of switches or a touch sensor or a plurality of optical sensor, to provide a means of entering and setting access code, a microcontroller programmed with software in combination with electronic circuitry to drive a miniaturized toggle solenoid or a micro motor to perform locking and unlocking functions. The compact electronic system unit fit to the mechanical housing to form a unitary embodiment of electronic locking device.

Using a set of mechanical switches or a sensor and software protocol, an automatic device "waking-up" method is derived to prevent unnecessary turning on its electronic system when not in used to conserve battery power. The electronic system is normally programmed to automatically power off and can be manually turned off using a press button. The electronic system can be activated by the following actions: 1). manually press an on/off button, 2). automatically triggered by a displacement sensor (e.g. acceleration sensor, vibration sensor, movement sensor) when an appropriate movement or combination of movements of the lock detected. The movement or combination of movements may be a preset pattern or combination of movements such as a press on the shackle bar followed by an immediate release against the body of the lock. This pattern or combination of movements may be predefined in the electronic system for the purpose of activating the electronic system or executing some other function.

The combination of electronic display, a 5-way switch Joystick or a touch sensor and the software in conjunction with an electronic controller, enable a vast variety and choices of access codes are constructed by an user. Access codes can be stored in memory of the electronic system. Alphanumeric characters, colors graphics, shapes, symbols, patterns and other language characters, and their combinations to form words, names, and others combination to produce a vast variety of high security access codes that are meaningful, user-friendly, and easy for user to remember. More than one access code can be set to enable several users to use one electronic combination lock with different access code set for the convenient of each particular user.

When using a touch sensor for access code entry, user can touch and scroll to search for the alphanumeric characters or patterns displayed on screen and click the choice for performing access code entry actions. The display unit (e.g. LCD display) can be illuminated to ease reading of access code in a less illuminated environment.

A separate battery operated electronic key unit, which contents a programmed access code and electronic circuitry, can be used in conjunction with the electronic combination lock. The electronic key can serve as: (1) a proximity controller to perform locking and unlocking actions (2) an alternative power source to boot up the electronic combination lock with a flatten battery. (3) Backup access code storage.

The invention thus provides a miniature, compact, easy for entering/setting vast choices of access code, user-friendly locking and unlocking features, low power consumption, easy to use electronic combination lock and can advantageously replace the use of conventional combination locks. These and other objects, advantages and features of the invention will be apparent from the following description of a preferred embodiment, considered along with the accompanying drawings.

BRIEF DESCRIPTION OF THE DRAWINGS

The details of the electronic combination lock and electronic key will be understood more clearly with reference made to the accompanying drawings, in which.

DESCRIPTION OF PREFERRED EMBODIMENTS

Figure 1:
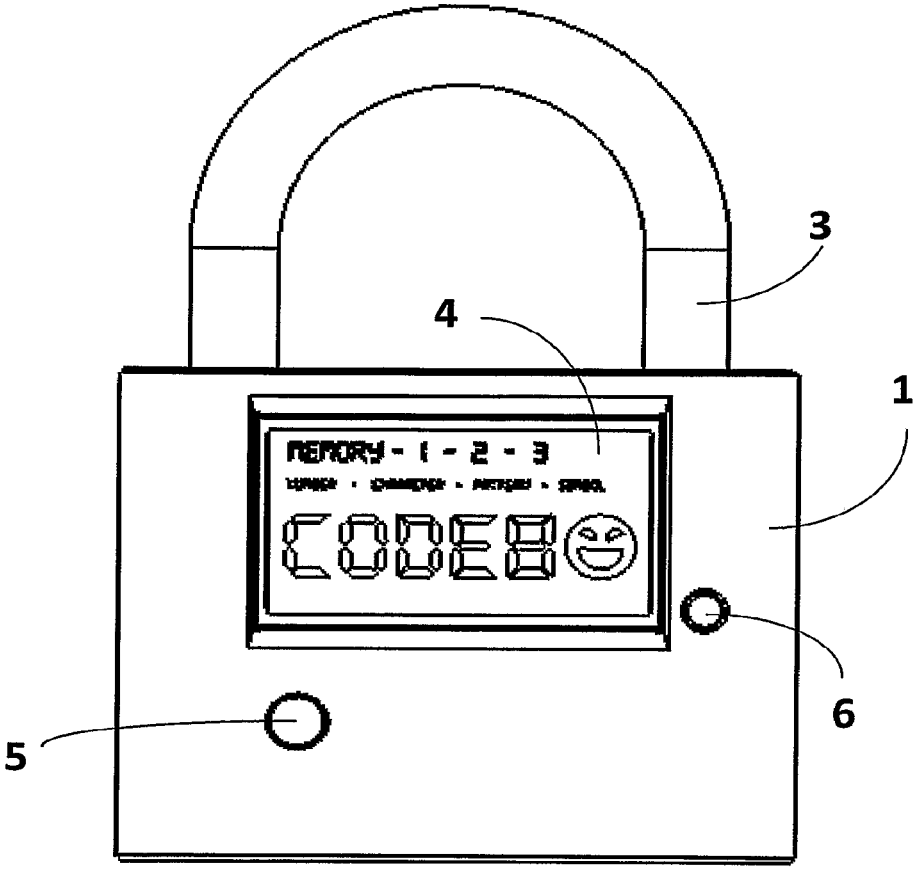
FIG. 1 is a front elevational view of one embodiment of the digital combination lock of the present invention.
Figure 2:
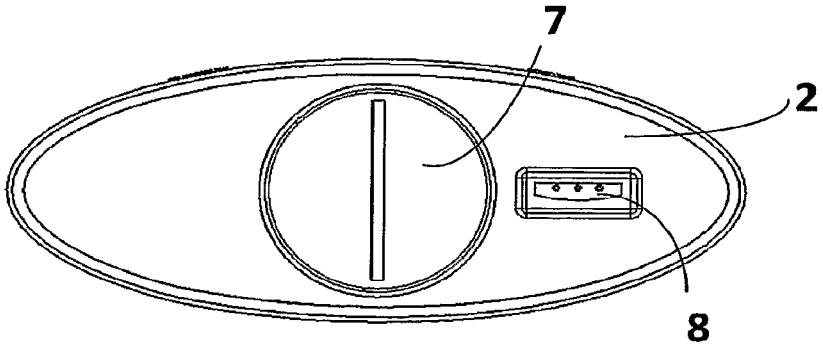
FIG. 2 is a bottom elevational view of the present invention showing a battery compartment and a key way.
Figure 5:
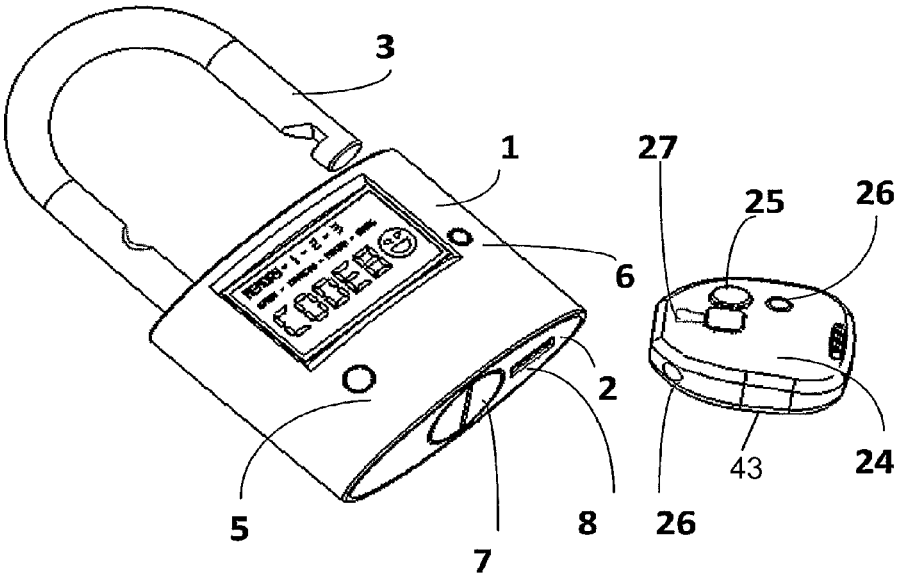
FIG. 5 is a front perspective view of the overall view showing a touch screen as the controller for the input of access codes into the invention.

An embodiment of an electronic combination padlock can best be appreciated by referring to FIGS. 1 and 2. The electronic combination lock having a mixture of metal and plastic material to form a housing structure 1, preferably elongated, consists of metal plates 2 on the top and bottom of the housing 1 to reinforce the structure. The lock has a shackle-type locking bar 3 that is held lock in position within the housing 1. The front side of the housing 1 has a back-lighted touch screen Liquid Crystal Display (LCD) 4 either by color pixels or dot matrix which is capable of displaying combination of alphanumeric characters, symbols and patterns. It will be appreciated that LCD screen 4 includes both a touch sensor and an electronic display unit. The touch feature on the LCD screen 4 allows entering and controlling locking features. The LCD screen 4 is automatically turned off within a short duration to conserve battery power. In this preferred form described herein, the electronic combination lock uses six "digital dials" access code (a smaller or larger number of dials can also be used). An On/Off push button 5 is situated below the LCD screen 4 to turn on or off the lock electronic system. Alternative method of turning On the device is achieved by shaking the lock which will trigger the movement sensor 16 and thus activating the electronic system of the electronic combination lock 17. The electronic system may be automatically activated, for example, by the movement sensor 16 (e.g. acceleration sensor, vibration sensor, displacement sensor), when an appropriate movement or combination of movements of the lock is detected. The movement or combination of movements may be a preset pattern or combination of movements such as a press on the shackle bar followed by an immediate release against the body of the lock. This pattern or combination of movements may be predefined in the electronic system for the purpose of activating the electronic system or executing some other function. As seen in FIG. 5, a receiver 6 for an infrared or radio frequency receiver system is situated to the right of the LCD screen 4 to receive signal from the electronic key 43 for performing locking and unlocking functions. The electronic key 43 may be in the form of a smartphone, tag, fob or some other smart device or the like that includes the necessary software and hardware to transmit infrared or radio frequency signals to the receiver 6 of the electronic system.

In embodiments, activating the electronic system of the electronic combination lock may also be achieved through a shaking of the electronic key 43 in an appropriate movement, pattern or combination of movements, which may be detected by a movement sensor within the electronic key 43, such as an acceleration sensor, vibration sensor, displacement sensor or the like. As with the shaking of the lock itself, the movement or combination of movements may be a preset pattern or combination of movements that are predefined for the purpose of activating the electronic system or executing some other function. The pattern of shacking of the electronic key 43 may generate a dedicated external proximity wireless signal to energize an antenna sensor through the receiver 6 of the electronic combination lock thus activating part or the entirety of the electronic system of the lock.

The bottom of the housing 9 is the battery compartment, which is enclosed by the battery cap 7. It permits two batteries 10 to be contained in the compartment. To the right of the battery cap 7 is the key hole 8 for the electronic key to be inserted in to unlock the electronic combination lock as an alternative method. When the electronic combination lock battery 10 has drained off completely, the battery source 22 from the electronic key can be used to power up the electronic combination lock. In an example embodiment, both the status of the electronic combination lock and a preprogrammed access code remain in an initial state as stored in a memory for the electronic system regardless of whether battery 10 is being removed or is completely discharged.

Figure 3:
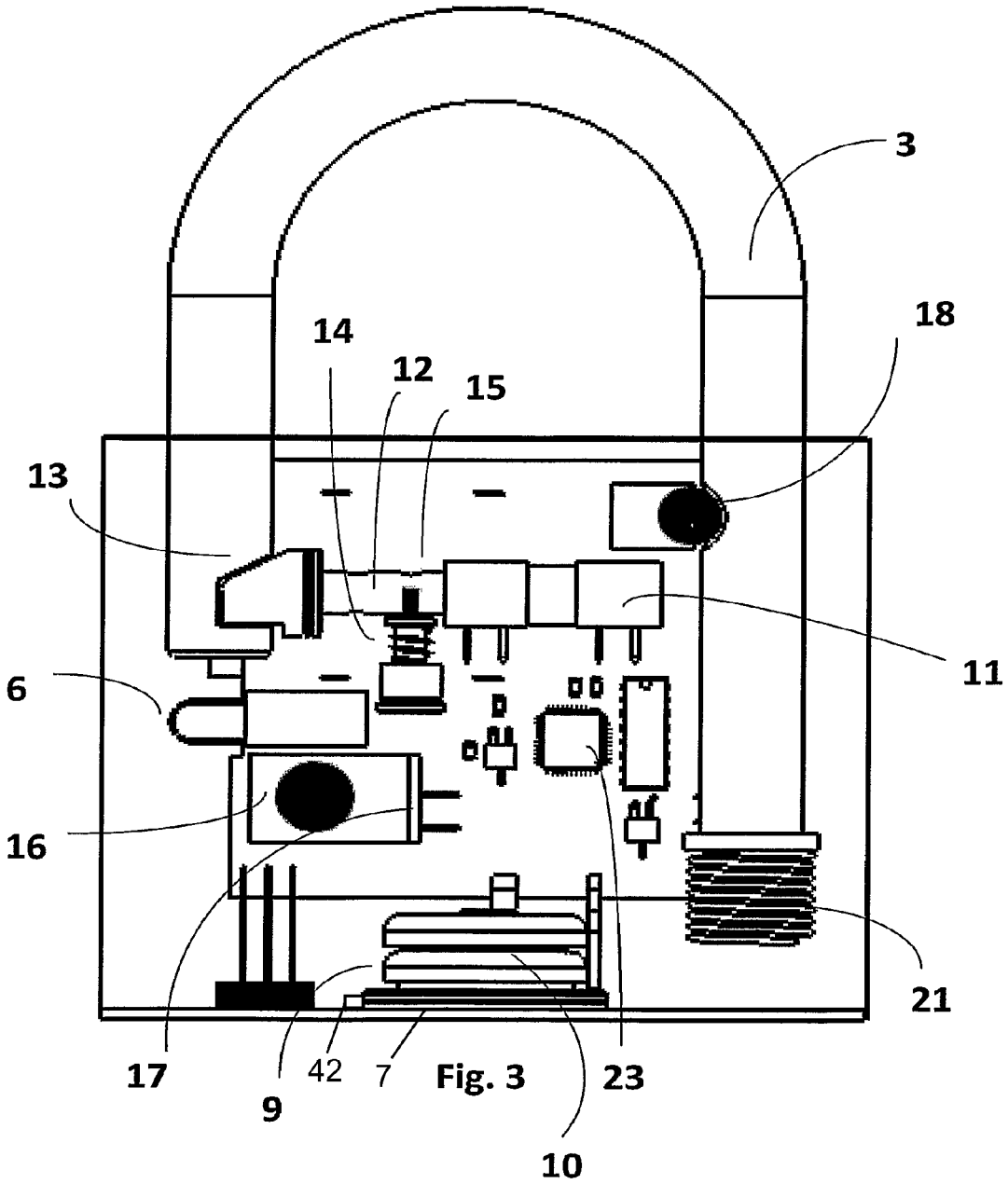
FIG. 3 is a back elevational view of the interior of the digital combination lock in closed position showing a solenoid locking into the shackle bar.
Figure 4:
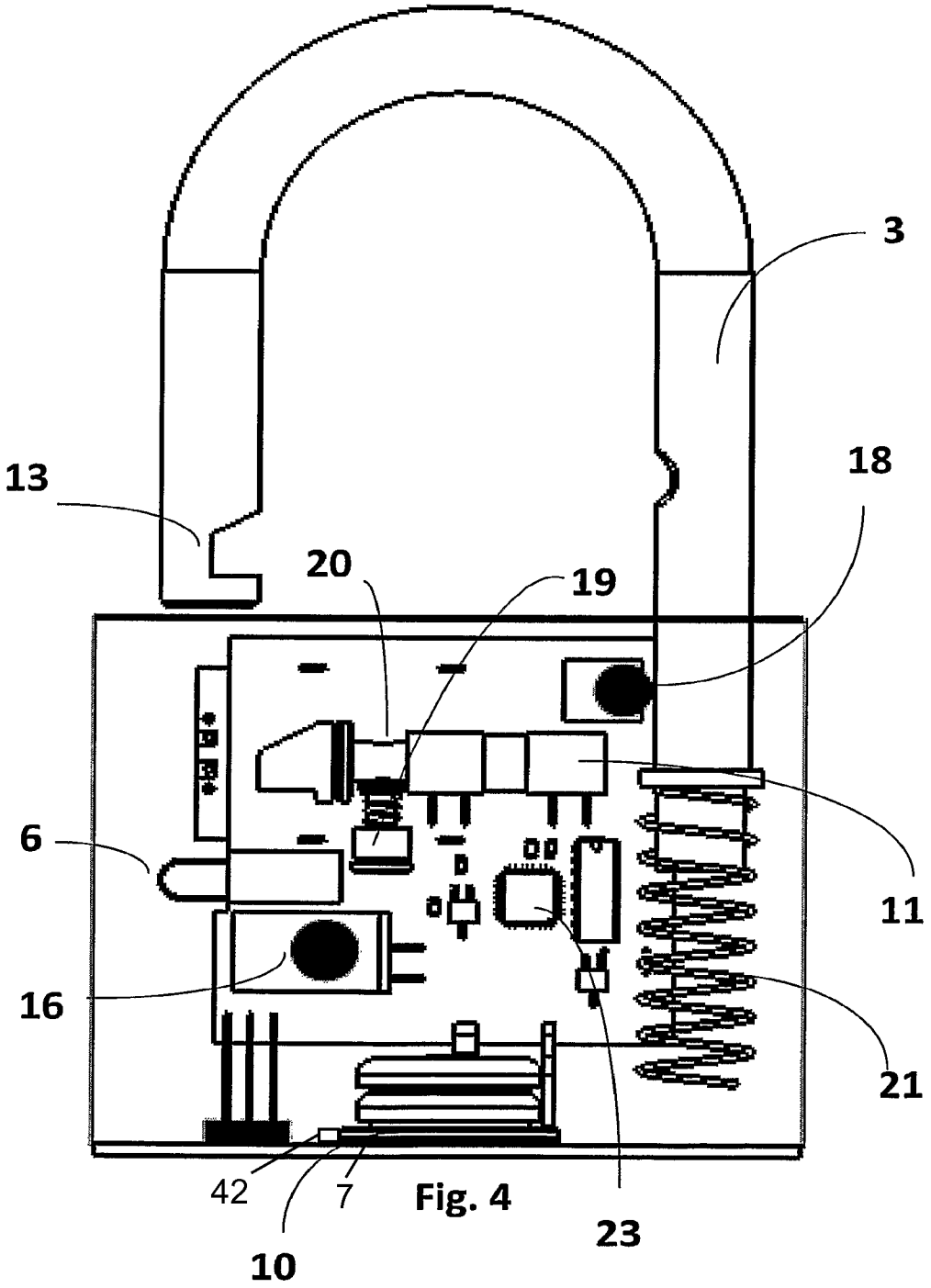
FIG. 4 is a back elevational view of the interior of the digital combination lock in opened position showing a solenoid releasing from the shackle bar.

Referring to FIGS. 3 and 4, the inner section of the housing 1 is preferably made from metal and the components are secured to the housing. The shackled bar 3 is held within the inner section by a solenoid 11 actuated bar 12 or a miniature motor. The shackled bar 3 is spring loaded 21 at one end. The shackle bar 3 is held by an actuated bar 12 secured into the groove 13 of the shackle bar 3. When an access code is entered by user to perform locking action, a signal is sent to the microcontroller 23 held on the circuit board, it drives the solenoid 11. The solenoid 11 will in turn actuate the actuated bar 12 to move forward. Upon actuation, actuated bar 12 will move into the groove 13 of the shackle bar 3 thereafter a second spring loaded bar 14 will move into the hole 15 of the actuated bar 12. The spring bar 14 acted as safety barrier to prevent the actuated bar 12 from unintentionally release from the latched position. A spring load ball bearing 18 is used to assist holding the shackle bar 3 in position for the actuated bar 12 to insert in and move out to accommodate latching and unlatching actions.

When an access code is entered on the electronic combination lock or a pre-programmed electronic key with access code is inserted into connector 8, a signal is sent to the microcontroller 23 to release the shackle bar to trigger the toggle solenoid 19 which in turn retracts the bar 14. Upon retraction, solenoid 11 will actuate to move the actuated bar 12 backward. Shackle bar 3 will spring out of the holding position into unlock position. After a certain duration solenoid 19 will release bar 14 into latching hole 20 to keep the actuated bar 12 from moving during unlocking state.

The electronic combination lock may also include a battery compartment lock 42 that secures the battery 10 in its battery compartment within the lock housing 1, shown in FIG. 1, by engaging and disengaging the battery cap 7 when the shackle bar 3 is in the locked position and unlocked position, respectively so that the battery 10 is inaccessible when the electronic combination lock is in the locked position.

Figure 6:
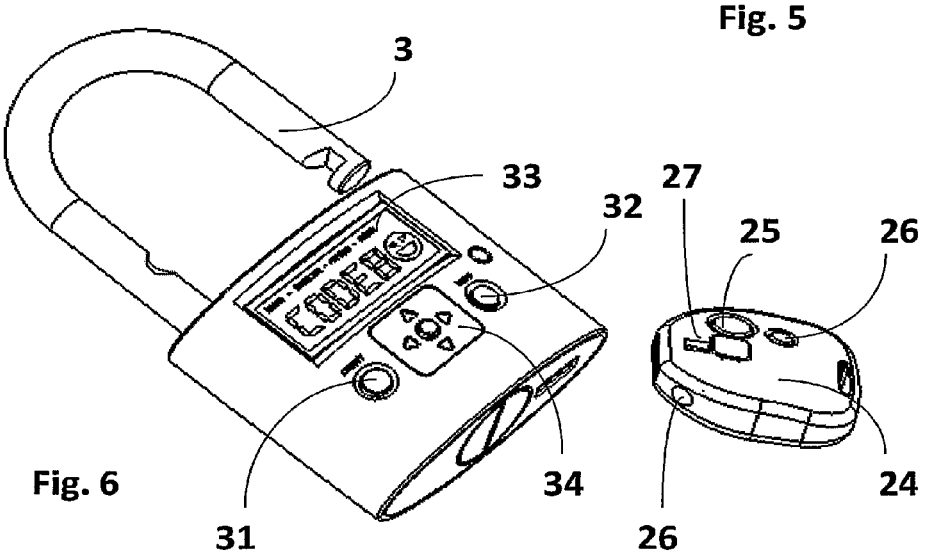
FIG. 6 is a front perspective view of the overall view showing a joystick as the controller for input of access code into invention.

Referring to FIG. 6, it shows another preferred embodiment using the joystick mechanism 34 as the input device. Access code 33 displayed on LCD screen can be in the forms of alphanumeric characters, symbols and patterns. On the right of the joystick mechanism is the mode button 32 to select a particular feature required. On the left is the On/Off button 31 to power On or Off the electronic system within the electronic combination lock.

Figure 7:
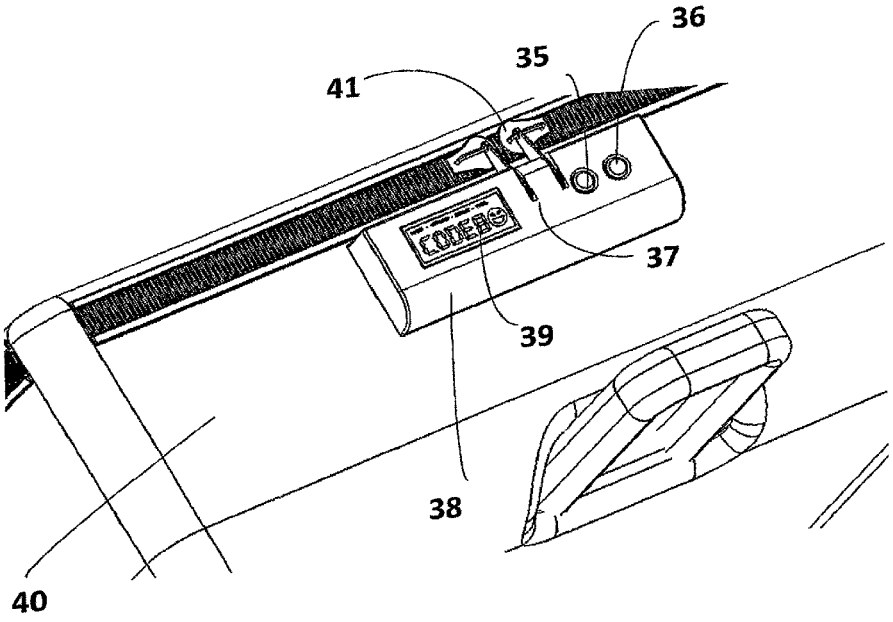
FIG. 7 is the front perspective view of the overall view showing the electronic combination lock embedded on a luggage bag.

FIG. 7 illustrates another preferred embodiment of the electronic combination lock embedded in a luggage bag 40. The pull tabs 41 of the luggage are to be inserted into the metal hooks 37 of the mechanical housing 38. In this embodiment, the shackle bar 3, shown in FIG. 1, may be in the form of one or more luggage zipper hooks or cylinder lock latches within the mechanical housing 38 that may be actuated to engage and disengage the pull tabs 41 to lock and unlock, respectively, the luggage bag 40 in substantially the same manner discussed above. Numerical 35 is the mode button to select a specific feature of the electronic luggage lock. On the right side of the mode button 35 is the On/Off button 36 to power on or off the electronic system. A LCD screen 39 is available for displaying access code and other features such as displaying lock status, wrong access code, selected type of code etc.

Figure 8:
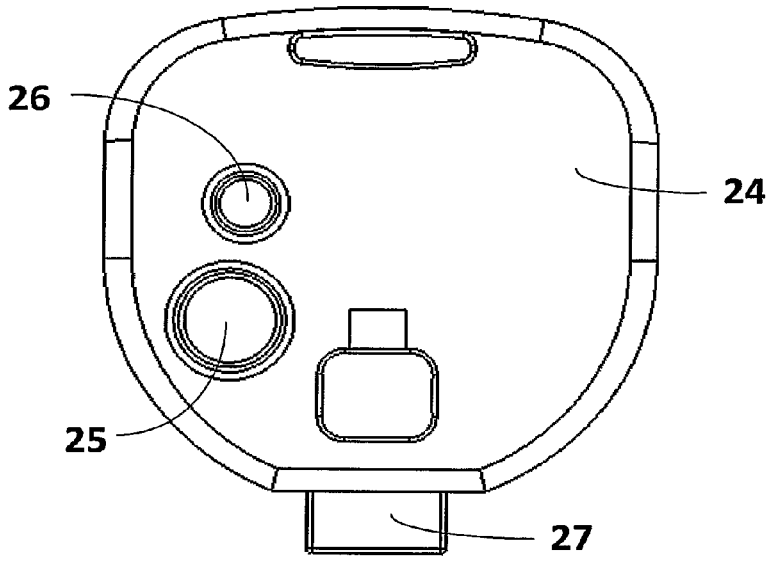
FIG. 8 is a top elevational of the electronic key showing a button extended the contact point out of the casing.
Figure 9:
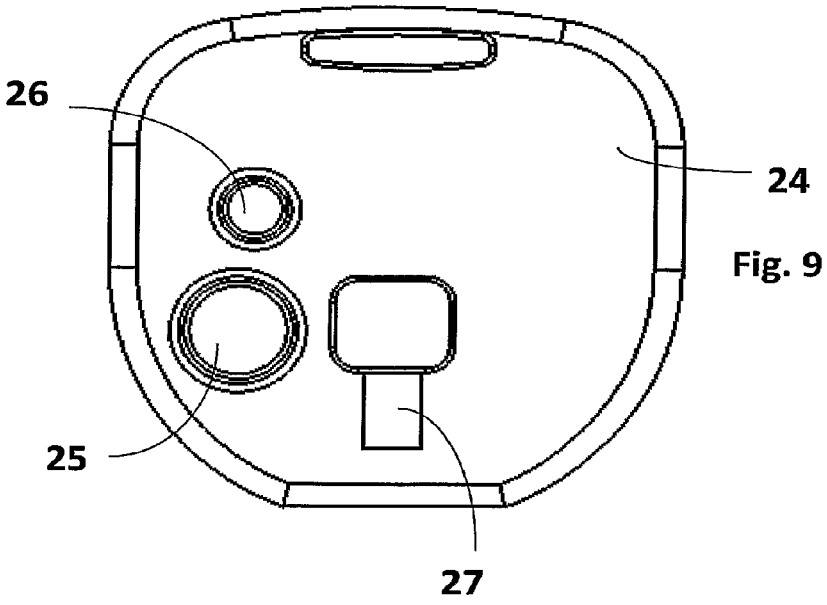
FIG. 9 is a top elevational of the electronic key showing the contact retracted into the casing.
Figure 10:
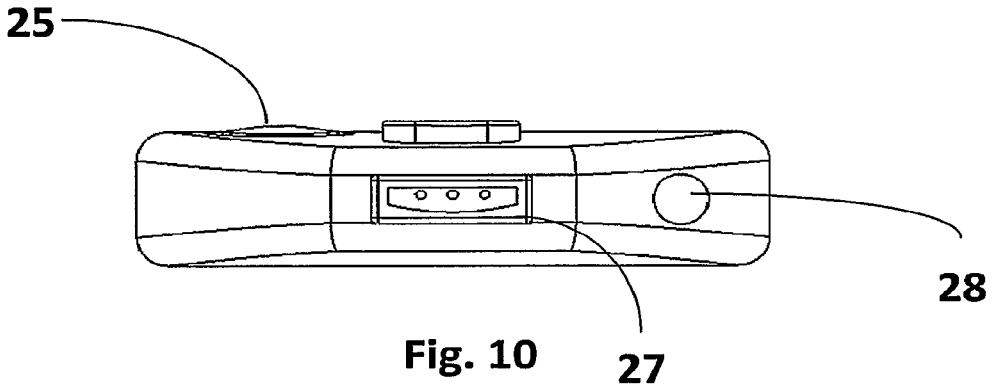
FIG. 10 is a front elevational of the electronic key showing the contact and infra red.
Figure 11:
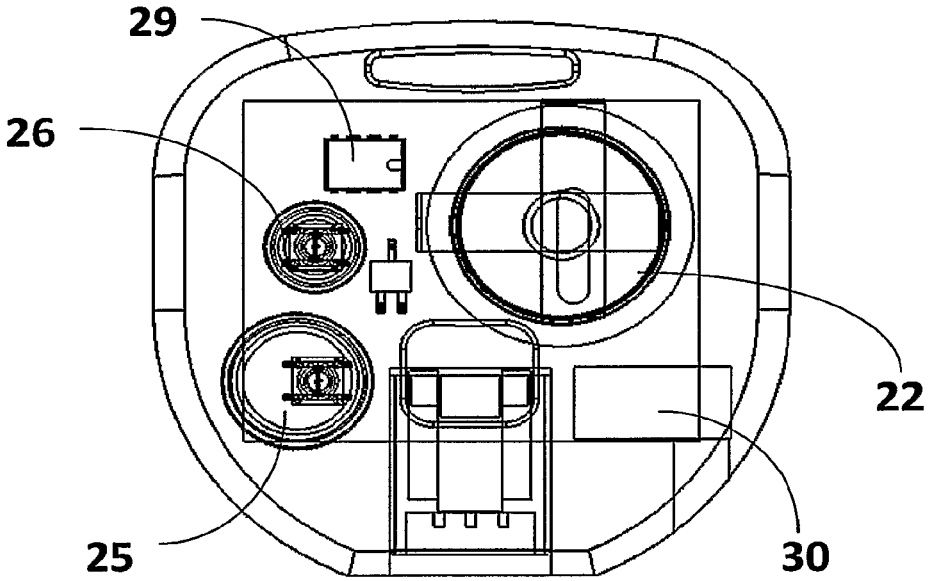
FIG. 11 is a top elevational of the electronic key showing the interior of the lock with all the components

Referring to FIGS. 8 to 10, the electronic key module comprises a plastic housing 24, unlock push buttons 25, lock push button a retractable connector 27 and infra red transmitter 28. The electronic key has two ways to open the electronic combination lock. Referring to FIG. 7, connector 27 is pushed out and inserted into the key hole 8 of the housing. The pre-programmed unlocking access code for the electronic lock is stored in memory of the integrated circuit 29. Upon insertion into the key hole 8, it sends a signal to the microcontroller 23 once the access code validated, the unlocking sequences is activated. This method of unlocking the electronic combination lock can be performed regardless the presence of battery source 10. For instance, the preprogrammed access code may be read by the electronic system of the lock to provide power to a dedicated electronic sub-system for triggering by-pass unlocking function of the said lock when the connector 27 is inserted in the key hole 8 in the housing. Alternative method of unlocking the electronic combination lock is to use the infra red transmitter 30. Within a proximity range of the circuit, with a press on the unlock button 26, a signal from the transmitter 30 sends to the receiver of the electronic combination lock 6 which then triggers the microcontroller to perform locking and unlocking sequences.

What is claimed is:

1. A miniature electronic lock comprising:
a housing that includes a battery compartment;
a shackle bar that fits into the housing;
a movement sensor that is an acceleration or vibration sensor disposed within the housing and configured to detect a pattern of shaking of the miniature electronic lock; and
an electronic system, protected by the housing, that includes memory storing a preprogrammed access code and that uses a microcontroller programmed by software to release the shackle bar upon the preprogrammed access code being received from a touch sensor and electronic display unit or from an electronic key, wherein the electronic system receives power from one or more batteries in the battery compartment, wherein the movement sensor provides power saving activation for the electronic system by activating the electronic system in response to the detected pattern of shaking of the lock.

2. A miniature electronic lock as in claim 1, wherein said pattern of shacking includes a press on the shackle bar followed by an immediate release against the housing of the lock to activate the electronic system.

3. A miniature electronic lock as in claim 1, additionally comprising a battery compartment lock that locks a battery cap of the battery compartment when the said shackle bar is in locking condition to secure the battery cap to the housing so that the one or more batteries in the battery compartment are inaccessible.

4. A miniature electronic lock as in claim 1, wherein both a status of the miniature electronic combination lock and the preprogrammed access code remain in an initial state as stored in a memory for the electronic system regardless of whether the one or more batteries in the battery compartment are being removed or are completely discharged.

5. A miniature electronic lock as in claim 1, further comprising a radio frequency receiver system to enable proximity access by the electronic key for input of the preprogrammed access code.

6. A miniature electronic lock as in claim 1, wherein the electronic key includes a connector and the preprogrammed access code is read by the electronic system when the connector is inserted in a key hole in the housing that is configured to receive the connector.

7. A miniature electronic lock comprising:
a housing that includes a battery compartment;
a shackle bar that fits into the housing;
a movement sensor that is an acceleration or vibration sensor disposed within the housing and configured to detect a pattern of shaking of the miniature electronic lock;
a touch sensor and electronic display unit;
a key hole in the housing that is configured to receive an electronic key;
a radio frequency receiver system to enable proximity access by the electronic key; and
an electronic system, protected by the housing, that includes memory storing a preprogrammed access code and that uses a microcontroller programmed by software to release the shackle bar upon the preprogrammed access code being received as input from either the touch sensor and electronic display or the electronic key, and wherein the displacement sensor provides power saving activation for the electronic system by activating the electronic system in response to the detected pattern of shaking of the lock.

8. A miniature electronic lock as in claim 7, wherein the electronic key is a smartphone, tag or fob.

9. A miniature electronic lock as in claim 7, wherein the electronic key includes a connector and the preprogrammed access code is read by the electronic system when the connector is inserted in the key hole.

10. A miniature electronic lock as in claim 7, wherein the electronic key includes at least one battery and electronic circuitry to provide power to the electronic system.

11. A miniature electronic lock as in claim 7, wherein the electronic key uses proximity access for input of the preprogrammed access code.

12. A miniature electronic lock system comprising:

an electronic key comprising:

a movement sensor that is an acceleration or vibration sensor configured to detect a pattern of shaking of the electronic key;

a miniature electronic lock comprising:

a housing that includes a battery compartment;

a shackle bar that fits into the housing;

a radio frequency receiver system to enable proximity access by the electronic key; and an electronic system, protected by the housing, that includes memory storing a preprogrammed access code and that uses a microcontroller programmed by software to release the shackle bar upon the preprogrammed access code being received as input from the electronic key, wherein the electronic system receives power from one or more batteries in the battery compartment, wherein the displacement sensor provides power saving activation for the electronic system by activating the electronic system in response to the detected pattern of shaking of the electronic key, wherein the electronic key includes at least one battery and electronic circuitry to provide power to the electronic system.

13. A miniature electronic lock system as in claim 12, wherein the shackle bar is in the form of luggage zipper hooks or cylinder lock latches.

14. A miniature electronic lock system as in claim 12, additionally comprising a battery compartment lock that locks a battery cap of the battery compartment when the said shackle bar is in locking condition to secure the battery cap to the housing so that the one or more batteries in the battery compartment are inaccessible.

15. A miniature electronic lock system as in claim 12, wherein the electronic key is a smartphone, tag or fob.

16. A miniature electronic lock system as in claim 12, wherein the pattern of shacking of the electronic key generates a dedicated external proximity wireless signal to energize the radio frequency receiver of the miniature electronic lock to activate at least part of the electronic system of the lock.

17. A miniature electronic lock system as in claim 12, wherein the electronic key includes a connector and the preprogrammed access code is read by the electronic system to provide power to a dedicated electronic sub-system for triggering a by-pass unlocking function of the lock when the connector is inserted in a key hole in the housing.

18. An electronic lock system as in claim 12, wherein the electronic key includes a connector and the preprogrammed access code is read by the electronic system when the connector is inserted in a key hole in the housing.

19. A miniature electronic lock system as in claim 12, wherein the electronic key uses proximity access for input of the preprogrammed access code.

20. A miniature electronic lock system as in claim 12, wherein the electronic key serves as a proximity controller for the electronic system.

* * * * *